US006363725B1

(12) United States Patent
Mei et al.

(10) Patent No.: US 6,363,725 B1
(45) Date of Patent: Apr. 2, 2002

(54) PRE-MIXING CHAMBER FOR GAS TURBINES

(75) Inventors: Luciano Mei, Sesto Fiorentino; Alessio Miliani, Impruneta, both of (IT); Anthony Dean, Scotia, NY (US)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 09/662,466

(22) Filed: Sep. 15, 2000

(30) Foreign Application Priority Data

Sep. 23, 1999 (IT) ..... MI99A1980

(51) Int. Cl.[7] ..... F02C 7/228; F02C 9/42
(52) U.S. Cl. ..... 60/737; 60/742; 60/748
(58) Field of Search ..... 60/737, 742, 748; 239/403, 405

(56) References Cited

U.S. PATENT DOCUMENTS

| | | | | | |
|---|---|---|---|---|---|
| 3,979,069 | A | * | 9/1976 | Garofalo | 239/405 |
| 4,023,351 | A | * | 5/1977 | Beyler et al. | 60/748 |
| 4,425,755 | A | * | 1/1984 | Hughes et al. | 60/742 |
| 4,967,561 | A | * | 11/1990 | Bruhwiler et al. | 60/737 |
| 5,288,021 | A | * | 2/1994 | Sood et al. | 60/742 |
| 5,404,711 | A | | 4/1995 | Rajput | |
| 6,073,436 | A | * | 6/2000 | Bell et al. | 60/742 |
| 6,202,152 | B1 | * | 4/2001 | Haffner et al. | 431/12 |

FOREIGN PATENT DOCUMENTS

| | | |
|---|---|---|
| EP | 0 747 636 A2 | 12/1996 |
| EP | 0 833 104 A2 | 4/1998 |
| EP | 0 838 633 A1 | 4/1998 |
| EP | 0 994 300 A1 | 4/2000 |

* cited by examiner

*Primary Examiner*—Ted Kim
(74) *Attorney, Agent, or Firm*—Nixon & Vanderhye

(57) ABSTRACT

A pre-mixing chamber (10) for gas turbines, wherein the gas turbine is of the type which comprises at least one compressor connected to the turbine, and a combustion chamber, wherein the combustion chamber has a converging portion (12), positioned such as to give rise to combustion inside the combustion chamber, and wherein the pre-mixing chamber (10) has a plurality of pipes (19) provided with holes (20), which open into the combustion chamber on a front portion of the body of the pre-mixing chamber (10), in order to generate a series of pilot flames, which are appropriately regulated, in order to stabilise a main flame, which is primed inside the combustion chamber, in which a front area of the converging portion (12) of the pre-mixing chamber (10) has at least one circular groove (28) provided at the holes (20) which belong to the pies (19).

14 Claims, 2 Drawing Sheets

PRE-MIXING CHAMBER FOR GAS TURBINES

The present invention relates to a pre-mixing chamber for gas turbines.

As is known, gas turbines are machines which consist of a compressor, and of a turbine with one or more stages, wherein these components are connected to one another by a rotary shaft, and wherein a combustion chamber is provided between the compressor and the turbine.

Air is supplied to the compressor from the outer environment, in order to pressurise the compressor.

The compressed air passes through a series of pre-mixing chambers, which end in a nozzle or a converging portion, to each of which there is supplied fuel, which in the case of gaseous fuel is mixed with the air, in order to form an air-fuel mixture to be burned.

There is thus admitted into the combustion chamber, by means of one or more burners, which are supplied by a pressurised network, the fuel which is necessary in order to produce the combustion, which is designed to give rise to an increase in the temperature and enthalpy of the gas.

The known burner units have a complex structure, inside which, in the case of gaseous fuel, there is present an element in the shape of an ogive, which in turn is contained inside a body which ends in a converging portion, which in current technical language is generally known as a shroud, and is connected to a corresponding mouth, which permits connection of the shroud to the combustion chamber.

Corresponding turbulence in the flow of compressed air obtained from the compressor is created downstream from the element in the shape of an ogive, by associating with each burner an element, which is generally known according to the art as a swirler, which intercepts the flow of air obtained from the compressor, and is provided with a complex shape, consisting of two series of blades oriented in opposite directions, all of which is designed to produce this turbulence.

The turbulence thus created permits inter alia corresponding mixing of the air itself with the fuel, in the combustion chamber.

In order to improve the characteristics of stability of the flame, in the case of use of gaseous fuel, there is also generally provided a parallel fuel supply system, which can generate a pilot flame in the vicinity of the output of the burner.

The assembly constituted by these elements makes it possible to create a flame which has a substantially annular shape, and is positioned inside the combustion chamber, in the vicinity of the dome of the latter.

Finally, via corresponding pipes, the high-temperature, high-pressure gas reaches the various stages of the turbine, which transforms the enthalpy of the gas into mechanical energy which is available to a user.

If the area in which the combustion takes place is observed in greater detail, it can be noted that typically, in a position which is at the front in relation to the pre-mixing chamber, dynamic balance is created, which makes it possible to position the flame at an appropriate distance from the converging portion of the pre-mixing chamber.

This dynamic balance depends on various parameters, amongst which the characteristic air/fuel ratio of the mixture to be burned if of particular importance.

In fact, if the mixture is too rich, there is a faster speed of reaction, which however can cause a back-firing of the flame, which can give rise to destruction of, or damage to, the units of the gas turbine.

In addition, a rich mixture causes an undesirable increase in pollutant secondary combustion products, and in particular an increase in the nitric oxides (NOx).

However, it is not generally possible to increase the air/fuel ratio above a certain threshold, since this decreases the speed of reaction, and the flame withdraws from the burner, until undesirable extinction of the mixture takes place.

The object of the present invention is thus to eliminate the disadvantages of the known art, by providing a pre-mixing chamber or gas turbines, which makes it possible to reduce drastically the additional fuel required, thus rendering the pollutant emissions minimal, and which simultaneously keeps the main flame stable over a period of time.

Another object of the present invention is to provide a pre-mixing chamber for gas turbines which is safe and reliable, and is designed such as to obtain also a substantial energy saving compared with the known art.

A further object of the invention is to provide a pre-mixing chamber for gas turbines which is relatively simple and economical to produce, as a result of the advantages obtained.

These objects are achieved by a pre-mixing chamber for gas turbines, wherein the said gas turbine is of the type which comprises at least one compressor connected to the turbine, and comprises a combustion chamber, wherein the said pre-mixing chamber has a converging portion, positioned such as to give rise to combustion inside and said combustion chamber, and wherein the said pre-mixing chamber has a plurality of pipes provided with holes, which open into the combustion chamber, provided on a front portion of the said pre-mixing chamber, in order to generate a series of pilot flames, which are appropriately regulated, in order to stabilise a main flame, which is primed inside the combustion chamber, characterised in that a front area of the said converging portion of the pre-mixing chamber has at least one circular groove provided at the said holes which belong to the said pipes.

According to a preferred embodiment of the present invention, the circular groove has a cross-section substantially in the shape of a "V".

According to another preferred embodiment of the present invention, at least one first surface which belongs to the converging portion has a partial protective coating, whereas a second surface of the converging portion, which also includes the V-shaped groove, is treated by means of a full protective coating.

According to another preferred embodiment of the present invention, the holes which belong to the pipes are disposed equidistantly in an annular direction, relative to a casing of the pre-mixing chamber.

According to a further preferred embodiment of the present invention, the converging portion of the pre-mixing chamber is connected in a detachable manner to the casing of the pre-mixing chamber itself.

Further alternative, preferred characteristics are described in dependent claims attached to the present patent application, to which reference is made for the sake of brevity.

The characteristics and advantages of the pre-mixing chamber according to the invention, for gas turbines, will become more apparent from the following description of a typical embodiment provided by way of non-limiting example, with reference to the attached schematic drawings, in which.

Figure 2:
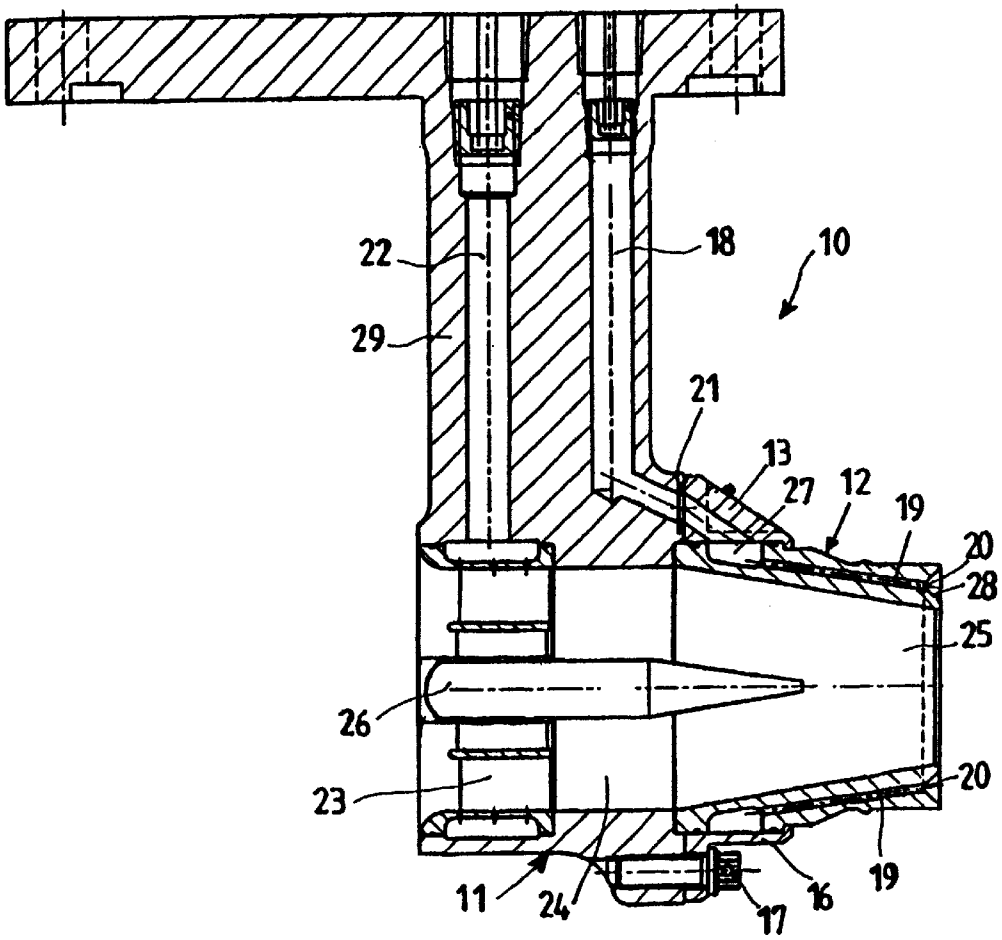
FIG. 2 shows in cross-section the pre-mixing unit in FIG. 1.

With particular reference to the aforementioned figures, the reference number 10 indicates as a whole the pre-mixing chamber according to the present invention.

The pre-mixing chamber 10 consists of a casing 11, which in turn is connected to a converging portion 12, which faces the combustion chamber (not shown for the sake of simplicity) of the gas turbine.

The pre-mixing chamber 10 is supported by a support column 29, in which there is also present a first duct 22 for admission of gaseous fuel into the pre-mixing chamber 10.

In greater detail, the converging portion 12 is connected to the casing 11 by means of a flange 12, which firstly clasps the converging portion 12 and retains it in a non-detachable manner, and secondly is connected in a detachable manner to the casing 11 of the pre-mixing chamber 10, all such as to render the converging portion 12 integral with the casing 11.

The flange 13 is produced by means of a bush element, in which the converging portion 12 is inserted, with the ends of the bush element connected firstly to the converging portion 12, and secondly to the casing 11.

A first end of the bush element of the flange 13 is provided with an edge 14, which projects towards the interior of the bush element itself, such as to form a shoulder, against which a projecting portion 15 of the converging portion 12 abuts.

In addition, a second end of the bush element supports a plate-type extension 16, which projects towards the exterior of the bush element, and abuts a front portion of the casing 11.

Above the bush element 13, there are provided three through holes, which are aligned with the equivalent number of through holes provided in the casing 11, in which screws 17 are provided as threaded locking elements, such as to produce a detachable connection between the converging portion 12 and the casing 11 of the pre-mixing chamber 10.

The converging portion 12 also has an annular cavity, on which the bush element 13 is superimposed.

The annular cavity, which is closed in this manner by the bush element 13, forms a distribution chamber 27 which communicates with a second duct 18 provided in a column-type support 29 in the pre-mixing chamber 10.

The distribution chamber 27 also communicates with further pipes 19 provided inside the body itself of the converging portion 12.

The pipes 19 end in holes 20 provided such as to open into the combustion chamber, on a front portion of the body of the pre-mixing chamber 10.

The duct 18 supplies fuel inside the distribution chamber 27, and from there the fuel is distributed through the pipes 19 into the combustion chamber, such as to feed a pilot flame, which usually has an annular configuration, and surrounds a main flame formed by combustion of the fuel.

In the embodiment shown by way of non-limiting example, there are eight pipes 19, provided inside the body of the converging portion 12, around a circumference, and equidistant from one another on the latter.

However, other configurations are possible for the holes 20 and the pipes 19, without departing from the context of the invention.

The fact that the converging portion 12 can be dismantled makes it possible inter alia to replace this converging portion 12 by another converging portion with a different configuration.

The duct 18 has two portions, i.e. a first portion is provided in the column-type support 29, whereas the opposite end ends with an enlargement, which constitutes a seat in which a sealing "Elicoflex" 21 is accommodated, between the first portion of the duct 18 and a second portion, which is provided on the bush element 13.

There is also associated with the pre-mixing chamber 10 an element or rotary unit 23, which is generally known according to the art as a swirler, is used to intercept the flow of air obtained from the compressor, has a complex shape, consisting of two blade assemblies which face in opposite directions, and is designed to produce a turbulent flow of air, in order to permit corresponding mixing of the air itself with the gaseous fuel obtained through the duct 22.

In its interior, the pre-mixing chamber 10 has a first, substantially cylindrical section 24, and a second, converging section 25, at the converging portion 12.

Inside the pre-mixing chamber 10, there is also present an ogive 26, which is secured at the swirler 23.

Figure 1:
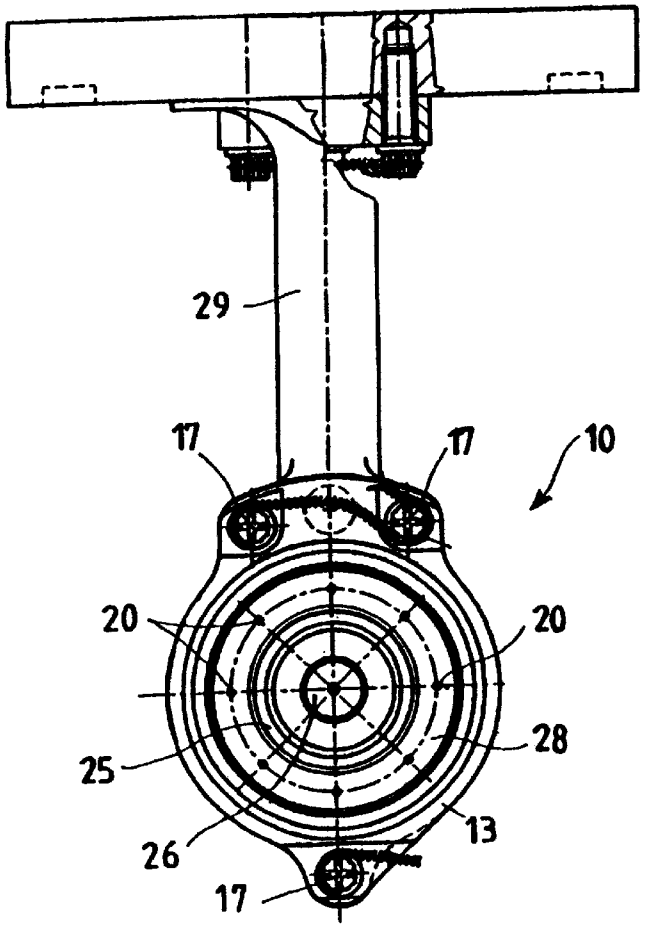
FIG. 1 shows an elevated front view of a pre-mixing unit, comprising a pre-mixing chamber according to the present invention.

When the converging portion 12 of the pre-mixing chamber 10 is observed from the front, according to the view in FIG. 1, it can be seen that there is a circular groove 28, provided such that it corresponds with the holes 20 in the pipes 19, and has a cross-section substantially in the shape of a "V".

Figure 4:
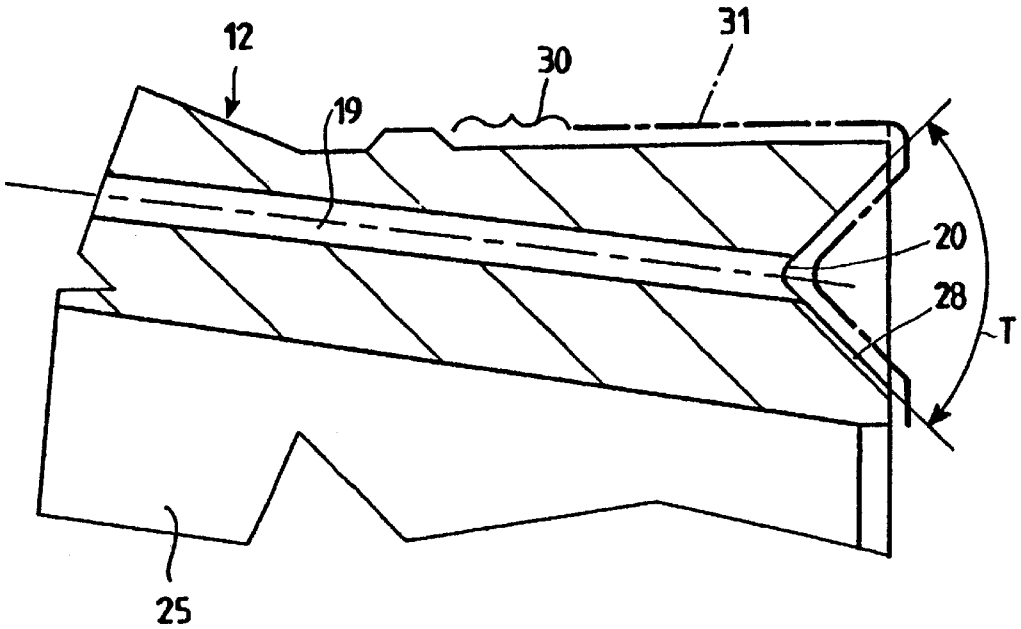
FIG. 4 shows in cross-section a detail belonging to the converging portion of the pre-mixing unit according to the invention.
Figure 3:
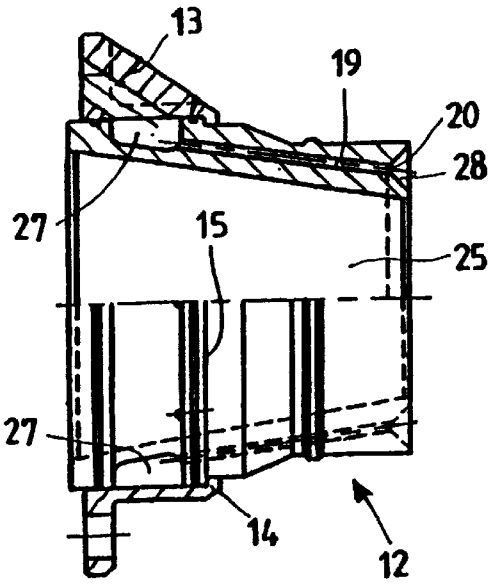
FIG. 3 shows a lateral view, partially in cross-section, of the converging portion which belongs to the pre-mixing chamber shown in FIG. 1.

A detail of this cross-section in the shape of a "V" of the groove 28 can be seen better in FIG. 4, which also shows one of the pipes 19 and the corresponding hole 20.

However, the circular groove 28 can also have a different shape for its own cross-section, for example a cross-section in the shape of a "U" or a "C", or a semi-circular cross-section etc.

More particularly, the groove 28 has an area for connection to the pipes 19 which is substantially inclined, i.e. which is in the shape of a cone, and has at least one angle at the vertex T.

The angle at the vertex T can vary within a preferred, but non-limiting interval of values, and specifically between 115° sexagesimal and 85° sexagesimal.

In this FIG. 4, it can also be noted that a first surface 30, which belongs to the converging portion 12, has a partial protective coating, whereas a second surface, which belongs to the converging portion 12, which also includes the groove 28, is treated by means of a full protective coating 31.

These protective coatings 30 and 31 consist of a particularly hard material, which as an anti-wear and anti-erosion function in hot conditions.

The functioning of the pre-mixing chamber 10 according to the present invention, for gas turbines, is now illustrated in detail.

The converging portion 12 of the pre-mixing chamber 10 is positioned such as to initiate combustion inside the combustion chamber (not shown).

The pre-mixing chamber 10, which is supplied by a pressure network, receives the gaseous fuel which is necessary in order to produce the combustion, which gives rise to an increase in the temperature and enthalpy of the gas.

More particularly, the fuel which is passed through the duct 22, is output via corresponding holes (not shown), and is mixed so as to form an air/fuel mixture with the air which is obtained from the compressor and passes through the swirler 23.

From the pre-mixing chamber 10, the air/fuel mixture formed as described passes through the converging portion 12, into the combustion chamber downstream.

Further gaseous fuel is supplied via the duct 18, such as to generate pilot flames, which are used to stabilise the main flame.

The flame is thus generated inside the combustion chamber, and is preferably kept in the vicinity of the dome of the combustion chamber itself.

The presence of the circular groove 28, provided such that it corresponds with the holes 20 in the pipes 19, at the front of the converging portion 12, permits improved stability of the flame, with all the other conditions remaining unchanged.

In particular, it should be noted that by providing this circular groove 28, it is possible to displace the limit of extinction of the turbine, in conditions in which the mixture is decidedly thinner than the limit which could be obtained according to the known art.

This phenomenon also makes it possible to reduce substantially the emissions of pollutant secondary combustion products, and in particular emissions of nitric oxide (NOx).

This means that the properties provided by the circular groove 28 permit a substantial increase in the operability of the machine, in particular in transient conditions and during functioning with low loads.

It is considered that one of the functions of the circular groove 28 is that it makes it possible to create re-circulation of the burnt particles or of the mixture and of the burnt gas, acting as an anchorage point which has an effect similar to self-ignition of the mixture.

The embodiment described relates to a turbine which is supplied with gaseous fuel, and it will be appreciated that the pre-mixing chamber according to the invention, provided with the V-shaped groove 28, can advantageously also be used with a turbine which is supplied with liquid fuel.

According to this embodiment, the shaped ogival element 22 must be replaced by a liquid fuel injector, which is supplied by means of a corresponding pipe.

It will be appreciated that modifications to, and variants of the present invention in addition to those already described are possible, for example it is possible to provide the V-shaped groove 28 in a pre-mixing chamber 10 in which the casing 11 and the converging portion are produced in a single piece.

In addition, as previously stated, the circular groove 28 can also have a different shape for its own cross-section, which for example can be in the shape of a "U" or a "C", or semi-circular etc.

Another important variant of the present invention is derived from the possibility of applying the concepts previously described not only to a turbine which uses gaseous fuel, or to a turbine of the dual-fuel type, but also to a turbine which uses liquid fuel.

In this case, in place of the ogive 26, there is present a liquid fuel injector (not shown), which is supplied by an appropriate pipe, and the pipes 19 and the corresponding holes 20 are not present.

However, in this case also, and for the purposes described, it is possible to provide a circular groove 28 in the front area of the converging portion 12 of the pre-mixing chamber 10.

The characteristics and advantages of the pre-mixing chamber which is the subject of the present invention are apparent from the description provided.

In particular, the advantages consist of the possibility of stabilising the flame in the combustion chamber, including in conditions which were not previously possible, thus preventing instability of the flame, major turbulence, or back-firing of the flame, which can cause serious disadvantages in terms of the general functioning of the machine, as well as breakdowns, stoppages, delays, repairs, extraordinary maintenance and additional costs, which should advantageously be reduced.

It is however apparent that many variants can be made to the pre-mixing chamber which is the subject of the present invention, without departing from the principles of novelty which are inherent in the inventive concept.

In the practical embodiment of the invention, any materials, shapes and dimensions of the details illustrated can be used, according to requirements, and can be replaced by others which are technically equivalent.

What is claimed is:

1. A premixing chamber for a gas turbine having a combustion chamber, comprising:

a premixing chamber body for simultaneously flowing fuel to the combustion chamber to generate a main flame and pilot flames, respectively, in the combustion chamber, said body including a converging portion for flowing a fuel/air mixture to the combustion chamber for generating the main flame, said premixing chamber body including a plurality of pilot passages which open into the combustion chamber along a front peripheral portion of said premixing chamber body for generating a series of pilot flames and stabilizing the main flame in the combustion chamber;

said front peripheral portion of the converging portion of the premixing chamber body having at least one peripheral groove surrounding a flow passage of said converging portion where the fuel/air mixture flows therethrough, said pilot passages opening into said groove.

2. A premixing chamber according to claim 1 wherein said peripheral groove has a substantially V-shaped cross-section.

3. A premixing chamber according to claim 2 wherein each of said passages opens into said V-shaped groove substantially at the apex of the groove, said groove being circular about said converging portion.

4. A premixing chamber according to claim 2 wherein each of said passages opens into said V-shaped groove substantially at the apex of the groove.

5. A premixing chamber according to claim 2 wherein said V-shaped groove has an included angle between 115° and 85°.

6. A premixing chamber according to claim 4 including at least a first surface of said converging portion having a partial protective coating and a second surface thereof having a full protective coating.

7. A premixing chamber according to claim 6 wherein said first surface is spaced from said groove.

8. A premixing chamber according to claim 4 wherein said converging portion is detachably connected to the casing of said premixing chamber.

9. A premixing chamber according to claim 4 including a support column for said premixing chamber body having a duct for transmission of gaseous fuel into said premixing chamber.

10. A premixing chamber according to claim 9 wherein said column includes a second duct for admission of pilot gaseous fuel into a distribution chamber in communication with said passages.

11. A premixing chamber according to claim 1 including, within said premixing chamber body, a swirler for imparting turbulence to the fuel/air mixture.

12. A premixing chamber according to claim 1 wherein said pilot passage openings are disposed equidistantly from one another in an annular array thereof about the premixing chamber body.

13. A premixing chamber according to claim 1 including a support column for said premixing chamber body having a duct for transmission of fuel into said premixing chamber, said column including a second duct for admission of pilot fuel into a distribution chamber in communication with said passages, including, within said premixing chamber body, a swirler for imparting turbulence to the fuel/air mixture, said pilot passage openings being disposed equidistantly from one another in an annular array thereof about the premixing chamber body.

14. A premixing chamber according to claim 13 wherein said peripheral groove has a substantially V-shaped cross-section having an included angle between 115° and 85°.

* * * * *

UNITED STATES PATENT AND TRADEMARK OFFICE

CERTIFICATE OF CORRECTION

PATENT NO. : 6,363,725 B1
DATED : April 2, 2002
INVENTOR(S) : Mei et al.

It is certified that error appears in the above-identified patent and that said Letters Patent is hereby corrected as shown below:

Title page,
Item [57], ABSTRACT,
Line 15, delete "pies (19)." and insert -- pipes (19). -- therefor.

Column 2,
Line 10, delete "or gas turbines," and insert -- for gas turbines, -- therefor.
Line 27, delete "inside and said" and insert -- inside the said -- therefor.

Column 3,
Line 19, delete "of a flange 12," and insert -- of a flange 13, -- therefor.

Column 6,
Line 44, delete "claim 4" and insert -- claim 1 -- therefor.
Line 50, delete "claim 4" and insert -- claim 1 -- therefor.
Line 53, delete "claim 4" and insert -- claim 1 -- therefor.

Signed and Sealed this

Twentieth Day of May, 2003

JAMES E. ROGAN
*Director of the United States Patent and Trademark Office*